United States Patent [19]
Whyte
[11] 4,285,086
[45] Aug. 25, 1981

[54] SELF-WRINGING MOP

[75] Inventor: Albert J. Whyte, West Springfield, Mass.

[73] Assignee: Standex Corporation, Salem, N.H.

[21] Appl. No.: 91,420

[22] Filed: Nov. 5, 1979

[51] Int. Cl.³ ..... A47L 13/146
[52] U.S. Cl. ..... 15/119 A
[58] Field of Search ..... 15/116 R, 116 A, 119 R, 15/119 A, 244 R

[56] References Cited

U.S. PATENT DOCUMENTS

| | | | |
|---|---|---|---|
| 2,251,384 | 8/1941 | Thomas | 15/119 A |
| 2,730,744 | 1/1956 | Vaughn | 15/119 A |
| 3,030,648 | 4/1962 | Greenleaf | 15/119 A |

*Primary Examiner*—Edward L. Roberts
*Attorney, Agent, or Firm*—Chapin, Neal & Dempsey

[57] ABSTRACT

Self-wringing mop includes a compressible head of sponge rubber or the like and a wringing mechanism which comprises a presser plate pivotable into compressive engagement with the mop head, an operating lever pivotally mounted on the mop handle, a cam lever pivotally connected to the operating lever and a cam disposed on the end of the cam lever such that actuation of the operating handle causes the cam to reciprocate over the surface of the presser plate while pivotally urging the presser plate into compressive engagement with the mop head.

12 Claims, 3 Drawing Figures

SELF-WRINGING MOP

BACKGROUND

This invention relates to self-wringing mops and more particularly to a wringer mechanism for a sponge mop.

Prior art sponge mops or "back presser" mops including a sponge block mounted on a backing plate transversely of the mop handle have gained wide acceptance for household use. Such sponge mops are generally provided with a mechanism by which the sponge block may be wrung out, this mechanism comprising a pressure or wringer plate hingedly connected to the sponge block backing plate and manually pivotable into compressive or wringing engagement with the sponge block. Most often, the pressure plate includes a short handle for the user to grasp when wringing out the sprong block. An example of such a prior art wringing mechanism is disclosed in U.S. Pat. No. 3,014,230 to Morgan.

While a prior art wringing mechanism of this type may allow the sponge block to be adequately wrung out, using such a mechanism is often awkward, requiring the user to expose his hands to cleaning solution.

Certain more recent prior art back presser mops, in efforts to alleviate such cleaning solution exposure and awkwardness, include various pressure plate handle extensions and linkages which seek to allow the mop to be wrung out from points on the handle remote from the mop head. However, such wringer mechanisms are often themselves awkward to use, and offer the user little if any mechanical advantage in pivoting the pressure plate. Moreover, for structural integrity, prior art wringing mechanisms are often constructed with double links connected to the pressure plate which add significantly to the weight and unwieldness of the mop. Examples of self-wringing mops employing such double link construction are found in U.S. Pat. Nos. 2,653,336 to Berndsen and 3,030,648 to Greenleaf.

Accordingly, it is a principal object of the present invention to provide a self-wringing mop which overcomes the deficiencies of the prior art.

It is another object of the present invention to provide a self-wringing mop which may be wrung out without exposing the user to the mopping solution.

It is another object of the present invention to provide a self-wringing mop which is convenient to use and light in weight.

It is another object of the present invention to provide a self-wringing mop characterized by an economy of structure.

SUMMARY OF THE INVENTION

These and other objects are fulfilled by the present invention wherein a self-cleaning mop having a compressible head of sponge or the like is provided with a wringing mechanism comprising an operating handle or lever pivotally mounted on the mop handle and a cam arm pivotally disposed relative to the operating lever. The cam arm carries a cam thereon which engages the surface of a presure plate disposed pivotally adjacent the mop head. Actuation of the operating handle causes the cam arm to drive the cam reciprocally over the surface of the pressure plate while pivoting the pressure plate into compressive interengagement with the mop head.

DESCRIPTION OF THE PREFERRED EMBODIMENT

Figure 1:
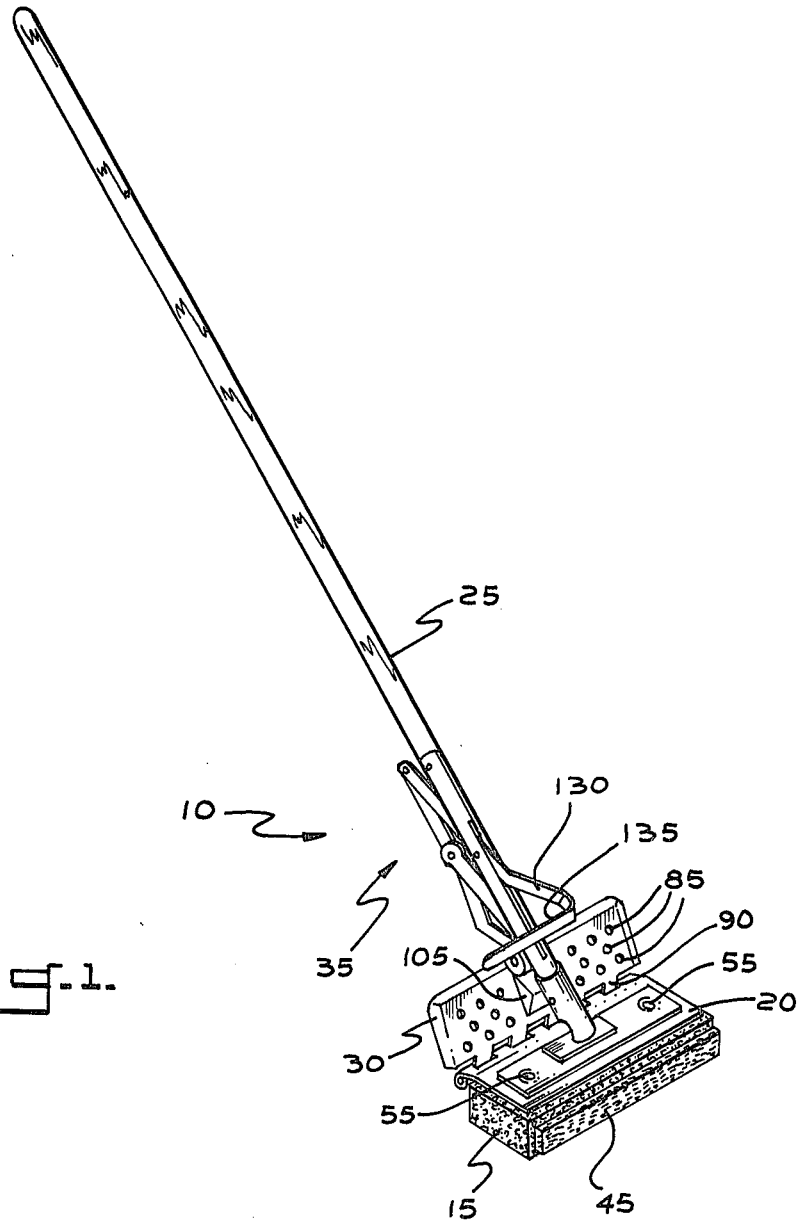
FIG. 1 is a perspective view of the self-wringing mop of the present invention.

Referring to the drawings, the self-wringing mop of the present invention is shown generally at 10 comprising a head 15 mounted on base plate 20 which in turn is fixed to the end of an elongated handle 25. A pressure plate 30 is disposed adjacent the base plate being pivotal with respect thereto and adapted to wring or compress the mop head between itself and the base plate. The pressure plate is operatively engaged by a wringing mechanism 35 which pivots the pressure plate into compressive interengagement with the mop head upon actuation by the user of operating handle or lever 40.

Head 15 is formed from a block of resiliently compressible material such as sponge rubber which will absorb the mopping solution and may be of any desired shape, with the block being generally trapezoidal in cross section in the preferred embodiment. The head may also be provided at a forward face thereof with an abrasive strip 45 for cleaning excessively soiled areas. The block is secured, as by adhesive bonding, to a rigid backing plate 50 of metal, plastic or the like which is bored to receive screes or similar fasteners 55 which maintain head 15 fixed to base plate 20.

Base plate 20 comprises a rigid plate of metal, plastic or the like, and as best illustrated in FIG. 1, the rear edge portion of the base plate comprises a plurality of parallel, rolled or curved fingers 60 which interdigitate with similar fingers formed in the forward edge of pressure plate 30 and function as knuckles in a hinge connection between those two members.

Handle 25 is elongated in structure and may comprise a solid or rigid tubular member. The lower end of the handle includes longitudinal slots 62 and 63 extending therethrough generally centrally thereof, the slots accommodating therewithin pivotal movement of portions of wringing mechanism 35. The lower end of handle 25 is provided with terminal member 65 having flanges 70 to which base plate 20 is secured as by rivets, fusion bonding or the like. In the preferred embodiment, terminal fitting 65 includes a sleeve portion 75 which receives the lower end of handle 25, the handle being riveted to the sleeve at 80.

Pressure plate 30 comprises a generally flat, rigid plate of metal, plastic or the like and may be provided with downturned edges to minimize outward splashing of the mopping solution during wringing. The plate is preferably apertured at 85 for the release of mopping solution therethrough during wringing and is provided with rolled fingers or hinge knuckles 90 which interdigitate with fingers 60 on base plate 20. A hinge pin 95 is received within the interdigitated hinge knuckles, completing the hinged interconnection of the base and wringer plate. The pressure plate is biased away from compressive engagement with sponge head 15 (clockwise in FIGS. 2 and 3) by a coil spring 100 carried on the hinge pin. The pressure plate also includes centrally at the back thereof a ramp cam follower 105 including greater 107 and lesser 109 sloping faces. The pressure plate engages the linkage of wringer mechanism 35 at the follower which provides an enhanced compression of the sponge head during mopping.

Figure 2:
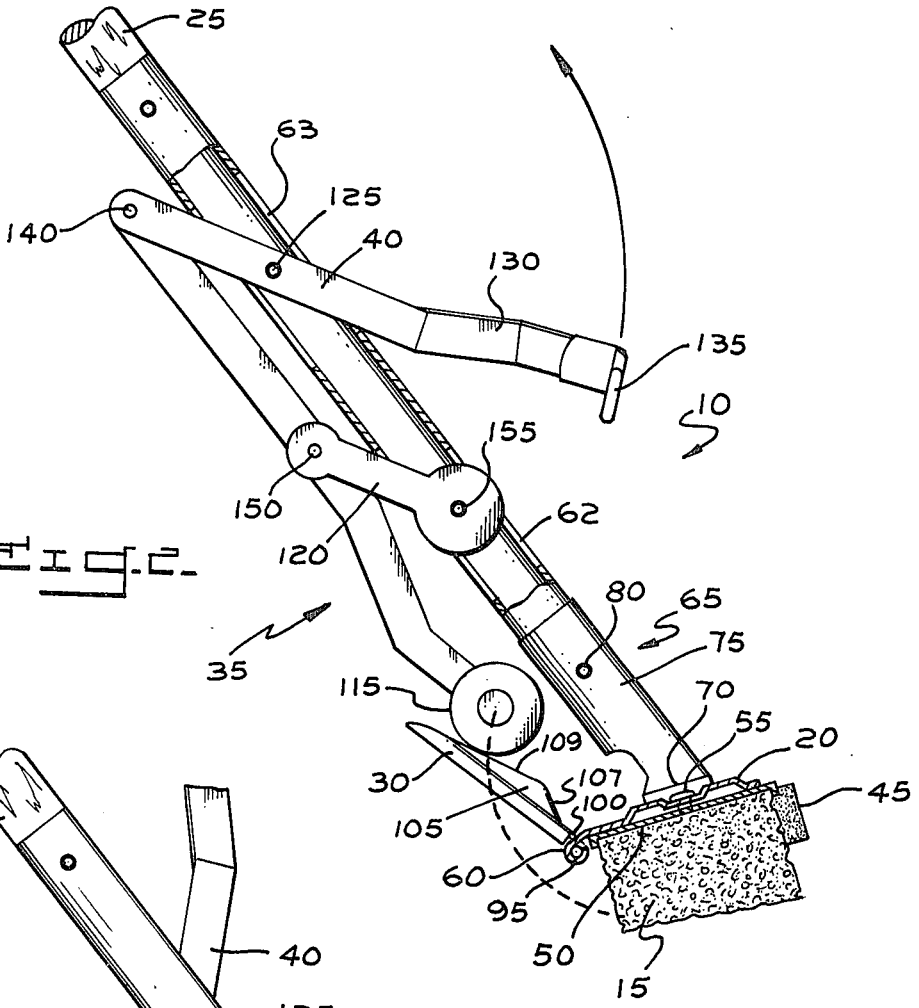
FIG. 2 is a partially sectioned, side elevation thereof.
Figure 3:
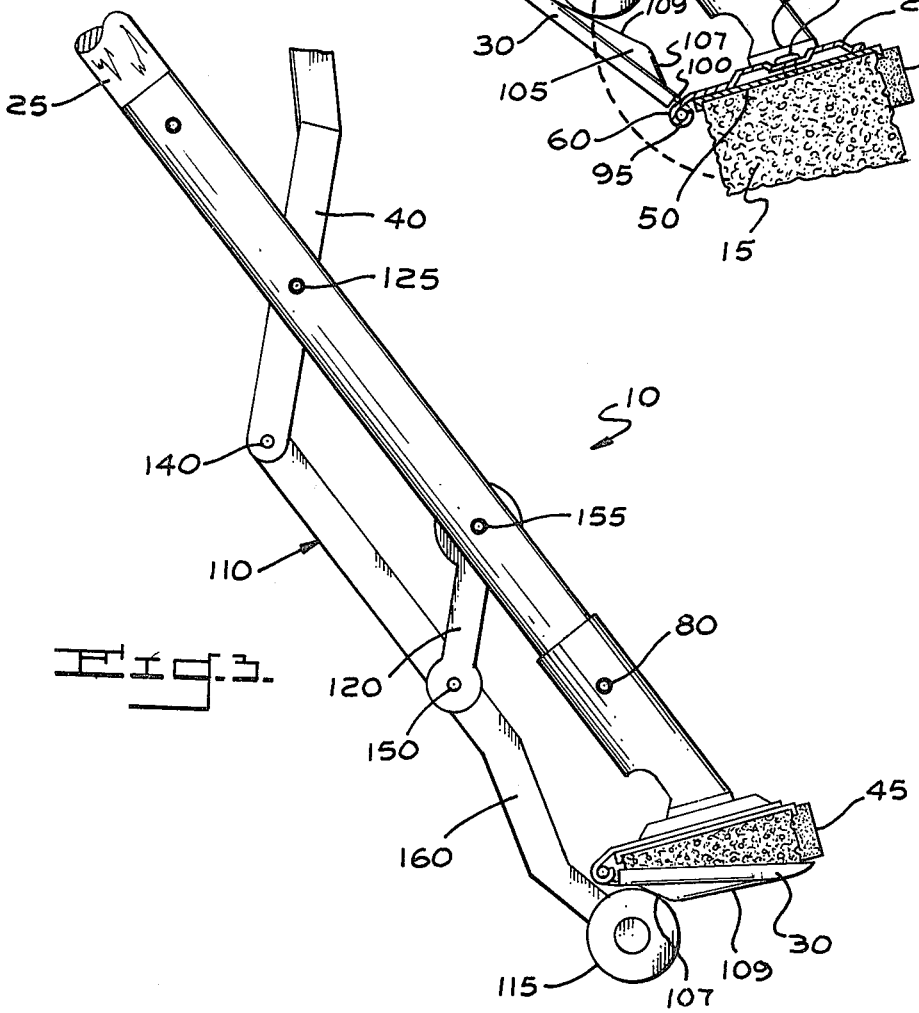
FIG. 3 is a view similar to FIG. 2 but showing the mop head being wrung out by the mop's wringing mechanism.

As best seen in FIGS. 2 and 3, the wringer mechanism linkage is generally a parallelogrammatic linkage and comprises with operating lever 40 and handle 25 a cam arm 110 carrying roller cam 115 and link 120.

Operating lever 40 is pivotally connected as by pinning to handle 25 interiorly thereof at 125 and generally centrally thereto and includes an angularly offset portion 130 and a transverse grip portion 135. Due to the angular orientation of lever 40 with respect to handle 25 lever 40 may be of a length yielding considerable mechanical advantage in wringing out the mop head yet normally extends only slightly outwardly from handle 25 whereby the lever interferes little, if any, with normal mopping. An end of operating lever 40 opposite grip portion 135 is pivotally connected to cam arm 110 at 140 as by pinning. The cam arm is also pivotally connected at 150 to link 120 which in turn is pivotally connected at 155 to the interior of handle 25 generally centrally thereof. It will therefore be seen that the parallelogrammatic linkage defined by operating lever 40, cam arm 110, link 120 and handle 25 collapses when lever 40 is drawn back (counterclockwise) in FIGS. 1 and 2 and cam arm 110 includes at one end thereof a V-shaped portion 160, the apex of this portion being laterally offset with respect to the remainder of the arm whereby interference between the arm and the hinged connection between the pressure and backing plates is avoided when the mop is wrung out.

Cam 115 is rotatably mounted on the end of cam arm 110 and in the preferred embodiment comprises a roller or wheel. The wheel may be formed of any material of sufficient strength to prevent deformation thereof. However, to reduce marring of the pressure plate and slipping of the wheel on the pressure plate surface, the wheel is preferably formed from a material softer than that used for the pressure plate. Thus, when the pressure plate is formed from steel, wheel 115 may be formed from various synthetic materials such as nylon, high density polyethylene or the like or natural materials such as wood. Since the operating lever and link are disposed generally centrally of handle 25 it will become apparent that the cam bar and roller are disposed centrally of the mop and the roller is positioned to engage follower 105.

Operation of the wringing mechanism is as follows: In normal mopping and storage, the wringer mechanism occupies the position shown in FIGS. 1 and 2, spring 60 maintaining the position of pressure plate 30 which urges cam arms 110 rearwardly, collapsing the linkage. When the mop is being used and it is desired to wring the mop out, the user draws back on operating lever 40 expanding and then collapsing the linkage, thereby moving the cam arm in an arcuate path forwardly away from, and then toward the mop handle. Thus, it will be seen that the roller cam travels along the path described by the dotted line of FIG. 2 thereby pivoting the pressure plate about its hinge, into compressive engagement with sponge head 15.

It will be seen that such movement of the cam roller will, while the pressure plate is pivoted, cause the roller to travel up lesser sloping face 109 of the follower, and back down the greater sloping face 107 to the hinge, at which point the pressure plate has begun compression. Continued counterclockwise pivoting of the operating lever causes the cam roller to then begin traversal of the pressure plate in an opposite direction relative thereto, back up the greater sloping face thereby progressively wringing out sponge head 15 (FIG. 3). It will be appreciated that in wringing out such a mop head, the linkage applies high force to the pressure plate. However, the provision of the roller contact with the pressure plate and the disposition of the operating lever and link centrally of the handle application of such force is achieved without resort to twin linkage portion links.

Thus, the weight of the wringing mechanism is held to a minimum.

When the mop is satisfactorily wrung out, operating lever 40 is released and spring 60 causes the pressure plate to pivot away from the sponge head thereby driving the cam arm and linkage to the positions occupied in FIGS. 1 and 2.

Having thus described the invention, what is claimed is:

1. Self-wringing mop comprising a compressible mop head fixed on the end of an elongated handle, a pressure plate pivotable into compressive engagement with said mop head, an operating lever pivotally mounted on said handle, a cam arm pivotally attached at an end thereof to said operating lever such that pivoting of said operating lever drives said cam arm toward said mop head, and a roller cam carried by said cam arm and movable reciprocably over a raised follower on the outer surface of said presser plate while pivotally urging said presser plate into compressive engagement with said mop head.

2. Self-wringing mop according to claim 1 wherein said cam arm comprises a generally straight portion and a generally V-shaped portion, the legs of said V-shaped portion defining a recess which prevents interference of said pressure plate by said cam arm as said cam reciprocates over said presser plate.

3. Self-wringing mop according to claim 1 wherein said follower includes greater and lesser sloping faces that are inclined at different angles to the outer surface of said presser plate.

4. Self-wringing mop comprising a compressible mop head disposed on the end of an elongated handle, a wringing mechanism supported by said handle said wringing mechanism including a wringer plate pivotally mounted adjacent said head and a manually actuable cam engageable with said wringer plate wherein said cam is movable along an arcuate path reciprocally over a raised cam follower on the outer surface of said wringer plate to thereby cause said wringer plate to pivot into compressible engagement with said head.

5. Self-wringing mop according to claim 4 wherein said cam comprises a roller rotatably fixed to a rigid cam arm actuable by an operating lever pivotally mounted to said elongated handle.

6. Self-wringing mop according to claim 4 wherein said cam arm is pivotally connected to an end thereof, to said handle and at a mid-portion thereof to an intermediate link pivotally connected to said elongated handle, said elongated handle and cam arm defining a first pair of generally parallel links and said operating lever and said intermediate link defining a second pair of parallel links, said first and second pairs of links being mutually oriented in a parallelogram linkage.

7. Self-wringing mop according to claim 6 wherein said operating lever and intermediate link are pivotally connected to said mop handle interiorly thereof.

8. Self-wringing mop according to claim 4 wherein said cam followeer includes greater and lesser sloping faces that are inclined at different angles to the outer surface of said wringer plate.

9. Self-wringing mop comprising a compressible mop head fixed on the end of an elongated handle, a presser plate pivotable into compressive engagement with said mop head, an operating lever pivotally mounted on said handle, a cam arm pivotally attached at an end thereof to said operating lever, a link pivotally attached at its ends to said elongated mop handle and a median portion of said cam arm, said link being disposed generally parallel to said operating lever whereby said elongated handle, operating handle link and cam arm comprise a parallelogrammatic linkage and pivoting of said operating lever drives said cam arm toward said mop head, and a cam, carried by said cam arm, and movable reciprocably over the outer surface of said presser plate while pivotally urging said presser plate into compressive engagement with said mop head.

10. Self-wringing mop according to claim 9 wherein said presser plate is biased away from said mop head, toward said elongted handle and said cam is held therebetween such that said cam arm is urged rearwardly whereby the exterior of said operating lever relative to said mop handle is minimized for compactness.

11. Self-cleaning mop according to claim 9 wherein said operating handle and link are pivotally connected to said elongated handle interiorly thereof.

12. Self-wringing mop according to claim 9 wherein said cam follower includes greater and lesser sloping faces that are inclined at different angles to the outer surface of said presser plate.

* * * * *